US005977525A

United States Patent [19]

Sahashi

[11] Patent Number: 5,977,525

[45] Date of Patent: Nov. 2, 1999

[54] CONTROL DEVICE FOR A HEATER FOR AN AIR FUEL RATIO SENSOR IN AN INTAKE PASSAGE

[75] Inventor: Masato Sahashi, Toyota, Japan

[73] Assignee: Toyota Jidosha Kabushiki Kaisha, Toyota, Japan

[21] Appl. No.: 09/055,404

[22] Filed: Apr. 6, 1998

[30] Foreign Application Priority Data

Apr. 16, 1997 [JP] Japan ..... 9-099123
Mar. 25, 1998 [JP] Japan ..... 10-077281

[51] Int. Cl.[6] ..... H05B 1/02

[52] U.S. Cl. ..... 219/494; 219/206; 219/497; 219/205; 219/505; 123/697; 123/704

[58] Field of Search ..... 219/202, 205, 219/207, 497, 505, 499, 492, 206; 123/434, 676, 685, 689, 697, 688, 686, 704; 374/164

[56] References Cited

U.S. PATENT DOCUMENTS

| | | | |
|---|---|---|---|
| 4,924,837 | 5/1990 | Chujo et al. . | |
| 5,214,267 | 5/1993 | Hoshi et al. | 219/497 |
| 5,656,190 | 8/1997 | Aoki | 219/205 |
| 5,731,570 | 3/1998 | Aoki | 219/497 |
| 5,782,227 | 7/1998 | Abe | 123/689 |

FOREIGN PATENT DOCUMENTS 62-78469 4/1987 Japan .

OTHER PUBLICATIONS

Sasayama et al., "Sensors and Sensing Technology for Low Emission and High Efficiency Powertrain Systems." Prescript of JSAE Scientific Conference 1995–5, No. 9534018, May 1995.

*Primary Examiner*—Mark Paschall
*Attorney, Agent, or Firm*—Oliff & Berridge, PLC

[57] ABSTRACT

A control device for a heater for an air fuel ratio sensor attached close to a sensor element of an air fuel ratio sensor located in an intake passage of an intake passage.

The control device comprises an ambient temperature related parameter detecting means for detecting a parameter related an ambient temperature of the air fuel ratio sensor, an intake air amount related parameter detecting means for detecting a parameter related amount of fresh intake air introduced into intake passage, and supply power controlling means for controlling supply power based on a parameter detected by an ambient temperature related parameter detecting means and a parameter detected by an intake air amount related parameter detecting means.

12 Claims, 12 Drawing Sheets

CONTROL DEVICE FOR A HEATER FOR AN AIR FUEL RATIO SENSOR IN AN INTAKE PASSAGE

BACKGROUND OF THE INVENTION

1. Field of the Invention

The present invention relates to a control device for a heater for an air fuel ratio sensor which is located in an intake air passage of an internal combustion engine.

2. Description of the Related Art

An engine control device which determines engine control parameters based on an oxygen concentration of intake air detected by an air fuel ratio sensor located in an intake passage has been disclosed. In Japanese Unexamined Patent Publication No. 62-78469, an air fuel ratio sensor which is provided with a heater for stabilizing an output of the air fuel ratio sensor is disclosed.

In the above type heater provided sensor, electric power supply to the heater is determined based on the amount of intake air. However, the air fuel ratio sensor is affected not only by an amount of intake air, but also by the temperature of ambient air around the sensor. For example, in the case that the engine has an EGR system which recirculates a part of exhaust gas to the intake passage upstream of the air fuel ratio sensor, the ambient air around the sensor is affected by the recirculated exhaust gas. Therefore, a system which determines the electric power supply for a heater based only on an amount of an intake air cannot always supply the required power appropriately. If excessive power is supplied, heater will be overheated and may be broken. If too little power is supplied, the sensor will not produce a proper output.

SUMMARY OF THE INVENTION

An object of the present invention is to provide a control device for a heater for an air fuel ratio sensor in an intake passage which determines a power supply for the heater based not only on an amount of intake air, but also based on temperature of the ambient air around the air fuel ratio sensor.

According to the present invention, there is provided a control device for a heater for an air fuel ratio sensor attached close to a sensor element of an air fuel ratio sensor located in an intake passage of an internal combustion engine, said control device comprising an ambient temperature related parameter detecting means for detecting a parameter related to an ambient temperature around said air fuel ratio sensor, an intake air amount related parameter detecting means for detecting a parameter related to an amount of intake air introduced into intake passage, and supply power controlling means for controlling the power supplied to said heater based on an ambient temperature related parameter detected by ambient temperature relating parameter detecting means and an intake air amount related parameter detected by an intake air amount related parameter detecting means.

The present invention may be more fully understood from the description of preferred embodiments of the invention set forth below, together with the accompanying drawings.

DESCRIPTION OF THE PREFERRED EMBODIMENTS

The first embodiment relates to a diesel engine having exhaust gas recircuration system.

Figure 1:
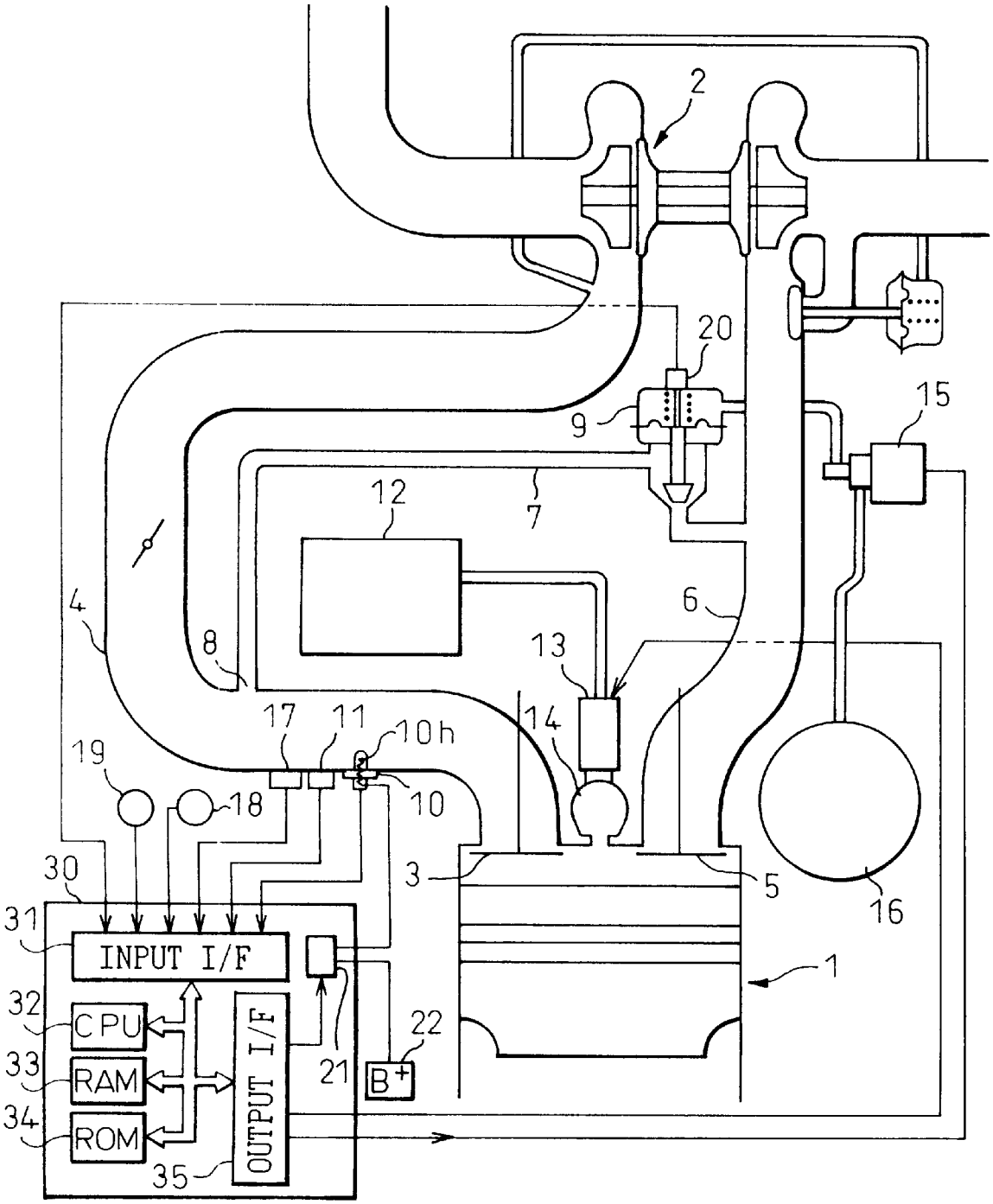
FIG. 1 shows a general construction of the first embodiment of the present invention.

Referring to FIG. 1, a diesel engine 1 provided with a turbo-charger 2 is shown. The engine 1 has an intake air passage 4 which introduces intake air to an intake valve 3 and a exhaust gas passage 6 which introduces exhaust gas discharged from exhaust valve 5 to atmosphere. Some of the exhaust gas is taken from an exhaust gas passage and is recirculated to intake air passage through an exhaust gas recirculating passage 7 which is connected to a recirculating gas inlet hole 8 in the intake air passage 4. The amount of the recirculation exhaust gas is controlled by the EGR control valve 9.

An air fuel ratio sensor 10 is located in an intake passage 4, downstream of the recirculating gas inlet hole 8 of the intake air passage 4, and it detects an oxygen concentration in an intake air which is introduced to a combustion chamber of the engine 1. An intake air temperature sensor 11, located near the air fuel ratio sensor 10, detects the temperature of an inlet air around the air fuel ratio sensor 10.

A fuel injection pump 12 pressurizes fuel from a fuel tank (not shown) and sends it to fuel injection valves 13. Fuel injection valves 13 inject the pressurized fuel to sub chambers 14 at a determined timing to cause self ignition.

A duty solenoid valve 15 controls a supply of vacuum pressure from vacuum pump 16 to a diaphragm chamber of the EGR control valve 9 by a duty control method so that the amount of a recirculation gas is controlled.

Here, a duty control method is a control method which is often used to change the rate of opening or closing of a valve. By duty control, the valve is cyclically opened and closed at a very high speed, and a ratio of the duration of the valve opening in one cycle, which is called duty ratio, is changed by a pulse signal from an electronic control unit. For example, if one cycle of the pulse is 100 msec, and the valve is opened for 50 msec, it can be said that the valve is opened with 50% duty ratio. This can provide a same effect as when a valve, having a mechanically adjusted valve element, is adjusted to half-opened position.

A pressure sensor 17 produces an output signal proportional to a pressure in the intake passage 4. An engine speed sensor 18 produces an output signal representing engine speed. A sensor 19 produces an output signal proportional to a depression of the accelerator pedal. A valve lift sensor 20 produces an output signal proportional to the movement of a valve element of the EGR control valve 9. These output signals are input to the input interface 31 of an ECU (Electronic Control Unit) 30.

A heater control circuit 21 controls the power supplied from power source 22 to a heater 10*h* for the air fuel ratio sensor 10.

The ECU 30 is a digital computer having an input interface 31, a CPU (Central Processing Unit) 32, RAM (Random Access Memory) 33, ROM (Read Only Memory) 34 and an output interface 35 which are interconnected to each other.

The ECU 30 controls electric power supply to the heater 10*h* based on signals from sensors as described below so that air fuel ratio sensor 10 is kept at a predetermined temperature. The ECU 30 also executes other controls, for example, fuel injection control, which are performed using the air fuel ratio sensor heated by the heater controlled by the present invention.

In FIG. 1, all the sensors for detecting different parameters used in the below described first to three embodiments are shown. However, all the sensors are not required in one embodiment. For example, the first embodiment requires pressure sensor 17, but does not require the sensor 19.

Figure 2:
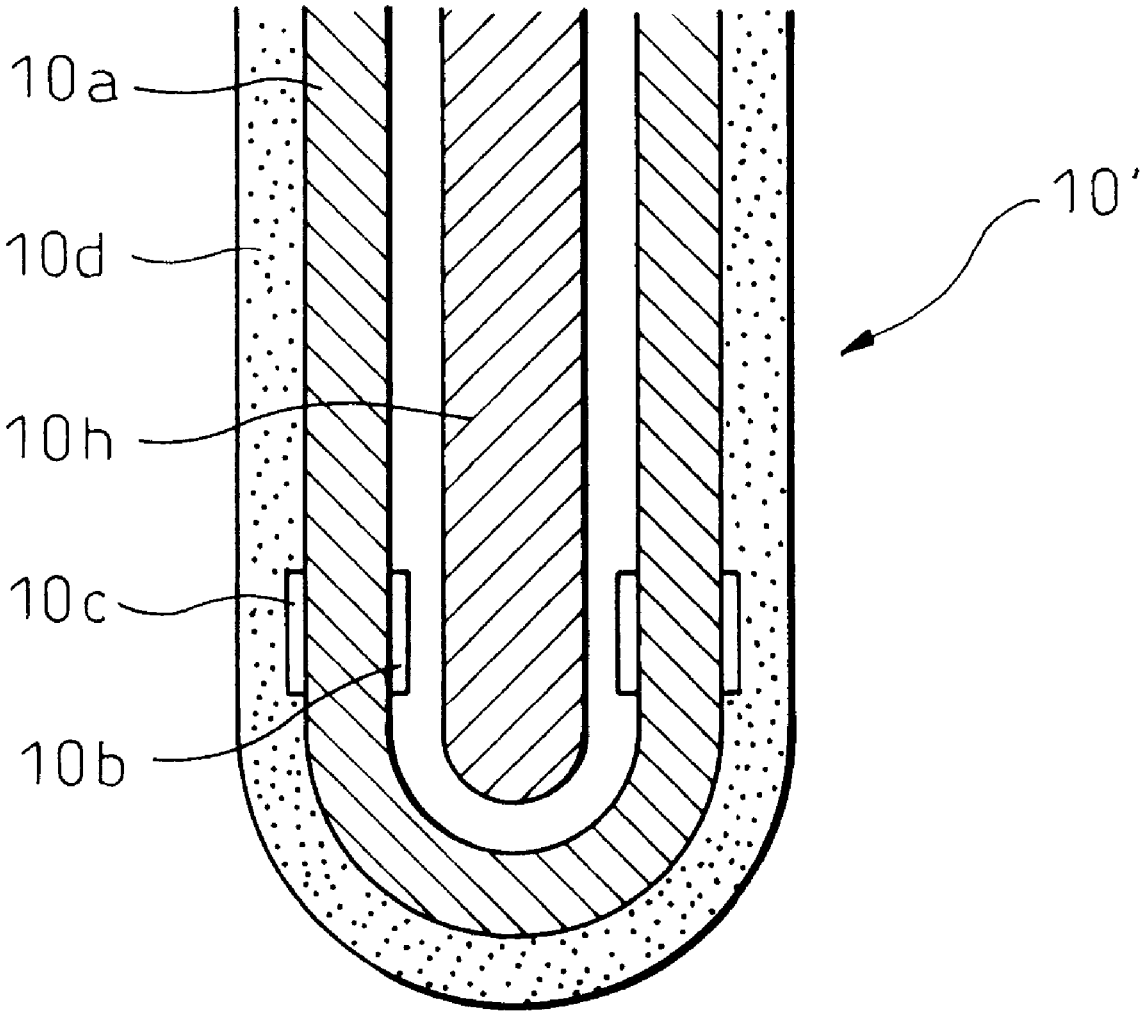
FIG. 2 shows a construction of an element of air fuel ratio sensor.

FIG. 2 shows in detail the construction of an element 10' of the air fuel ratio sensor 10. The element 10' is composed of a solid electrolyte 10*a* made of zirconia, positive and negative electrodes 10*b* and 10*c* which are made of platinum and are formed on both sides of the solid electrolyte 10*a*, a diffusion control layer 10*d* which is formed outside the negative electrode 10*c* and is made of porous material, and a heater 10*h* relating to the present invention.

A predetermined voltage is impressed between the positive electrode 10*b* and the negative electrode 10*c*, and thereby oxygen ions tend to flow from the positive electrode 10*b* to the negative electrode 10*c*. This ion flow can be detected as an electric current. This electric current increases in accordance with an increase of the impressed voltage. However, by disposing the diffusion control layer 10*d*, the electric current is saturated to a certain value after it increases in accordance with an increase in the impressed voltage. This saturated electric current corresponds to an oxygen concentration in the intake passage. Therefore, oxygen concentration in the intake passage can be detected by measuring the electric current (limiting current) flowing between the positive electrode 10*b* and the negative electrode 10*c*.

Figure 3:
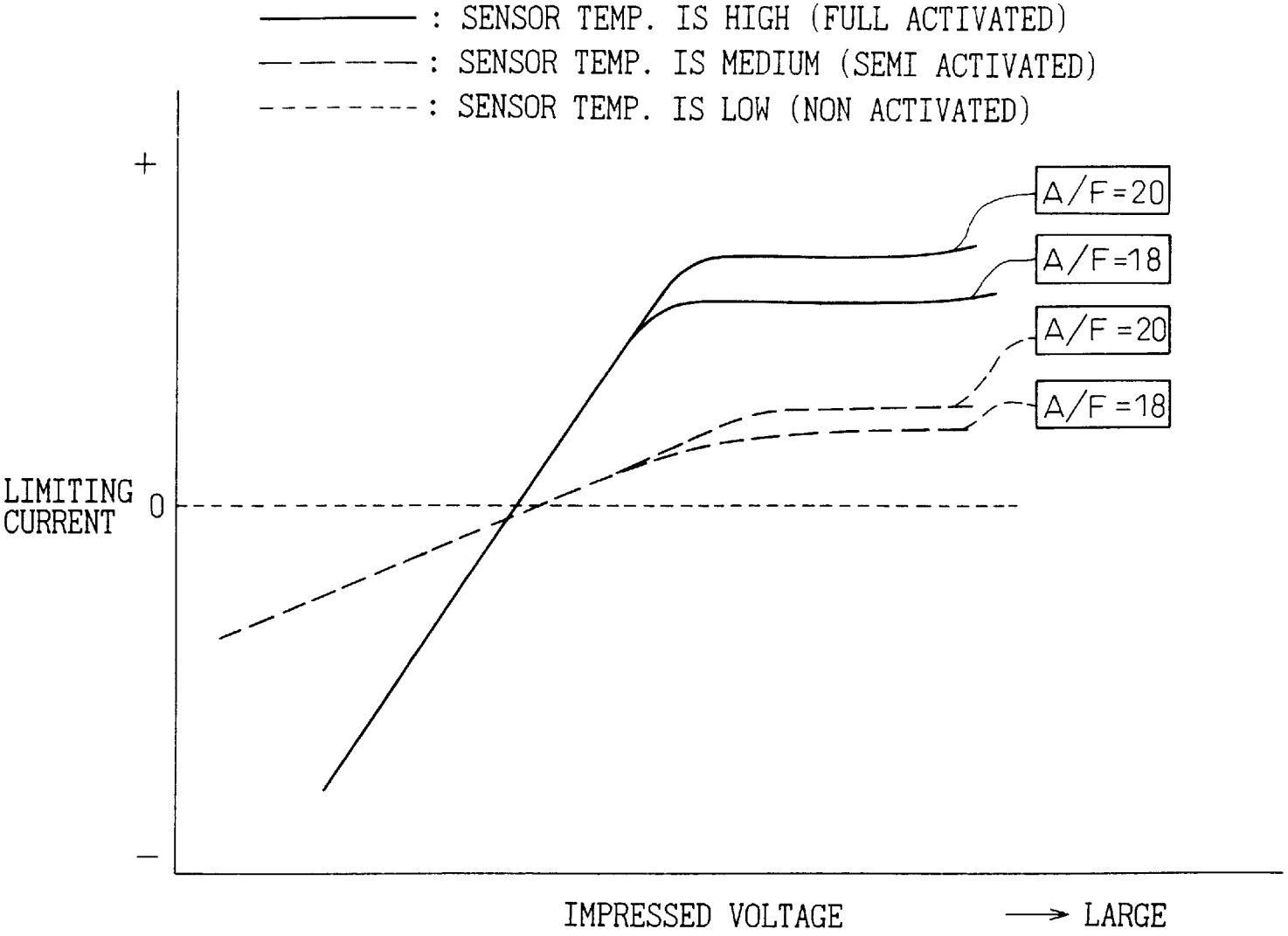
FIG. 3 is a diagram showing an output of air fuel ratio sensor changing in accordance with temperature.

The electric current changes in accordance with temperature of the element 10' as shown in FIG. 3. No limiting current flows when temperature of the element 10' is below a certain temperature. The limiting current begins to flow when the element 10' reaches a certain temperature. The current increases in accordance with an increase of the temperature of the element. When temperature of the element exceeds a certain value, for example 700° C., the current is stabilized. To obtain this stabilized condition, the element is heated by the heater 10*h*.

A controlling principle for the power supply to the heater will be described.

In embodiments of the present invention, of which details will be described later, a basic power supply PB is calculated based on an inlet air amount related parameter detected by inlet air amount related parameter detecting means. Basic power supply PB is corrected by power supply correction PC which is calculated based on ambient temperature related parameter detected by ambient temperature related parameter detecting means and, thereby, an actual power supply PA is obtained.

The following is an equation for correction.

$$PA=PB-PC \quad \ldots (1)$$

Figure 4:
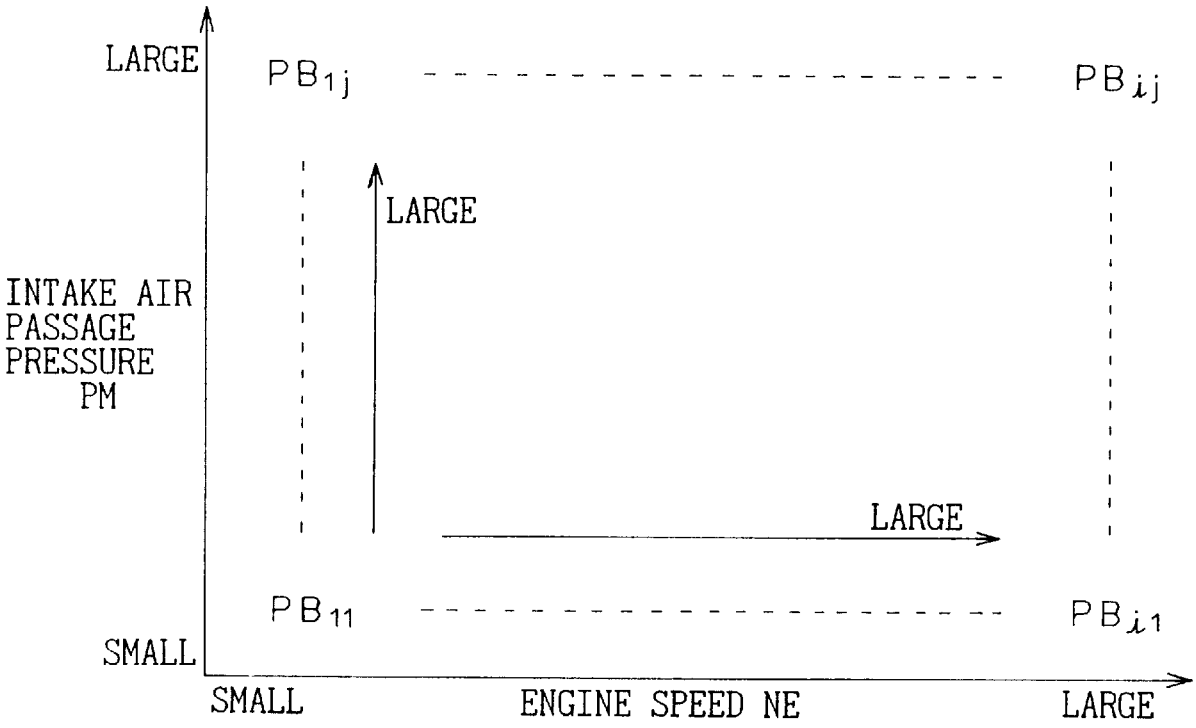
FIG. 4 is a diagram showing a required basic power supply to engine speed and intake passage pressure.
Figure 5:
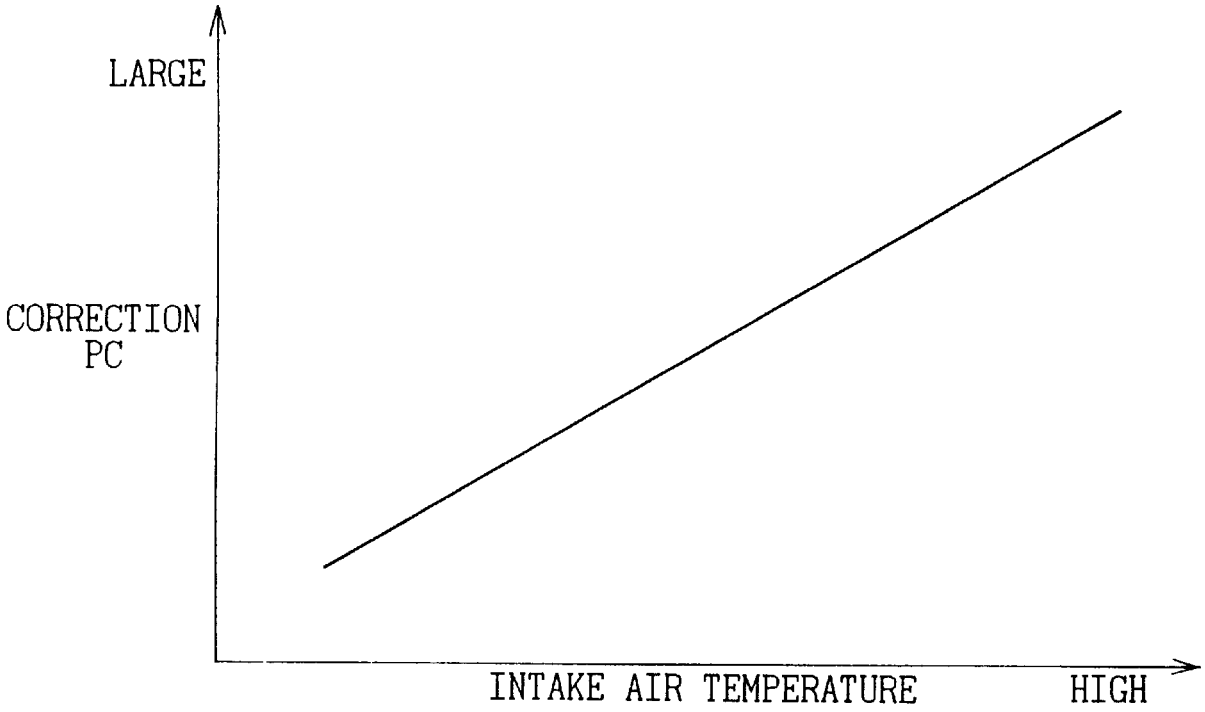
FIG. 5 is a diagram showing a correction to basic power supply against a temperature of intake air.

In the first embodiment, based on engine speed NE detected by engine speed sensor 18 and an intake passage pressure PM detected by intake passage pressure sensor 17, a basic power supply PB is obtained from a map as shown in FIG. 4, which is stored in ROM 34 of the ECU 30. The power supply correction PC is obtained from a map as shown in FIG. 5 which is stored in ROM 34 of the ECU 30 based on an intake air temperature TA detected by the intake air temperature sensor 11.

Figure 6:
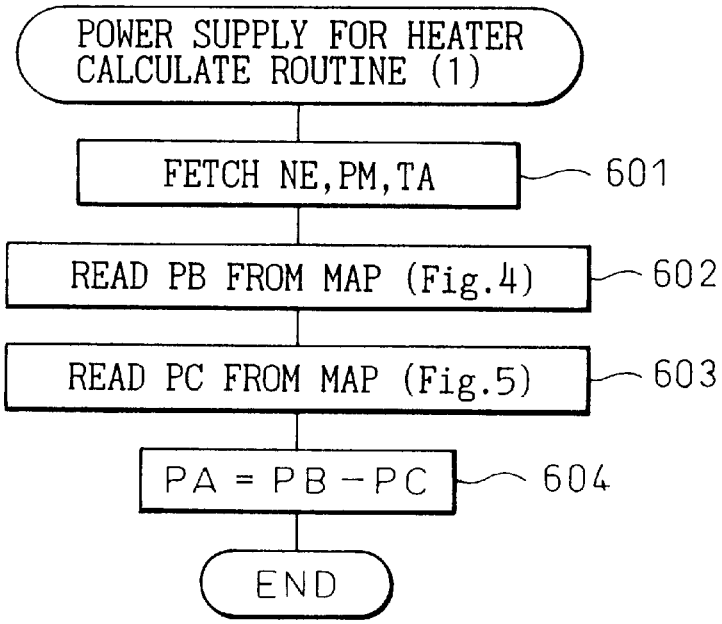
FIG. 6 is a flow chart for executing a control by a first embodiment of the present invention.

Shown in FIG. 6 is a flow chart to execute the above described control routine. In step 601, engine speed NE, intake passage pressure PM, and intake air temperature TA are fetched. In step 602, a basic power supply PB, corresponding the engine speed NE and intake passage pressure PM, is obtained from a map. In step 603, a correction PC corresponding to intake air temperature TA is obtained from a map. Finally, in step 604, the actual power supply PA is calculated by subtracting the power supply correction PC from the basic power supply PB.

Figure 7:
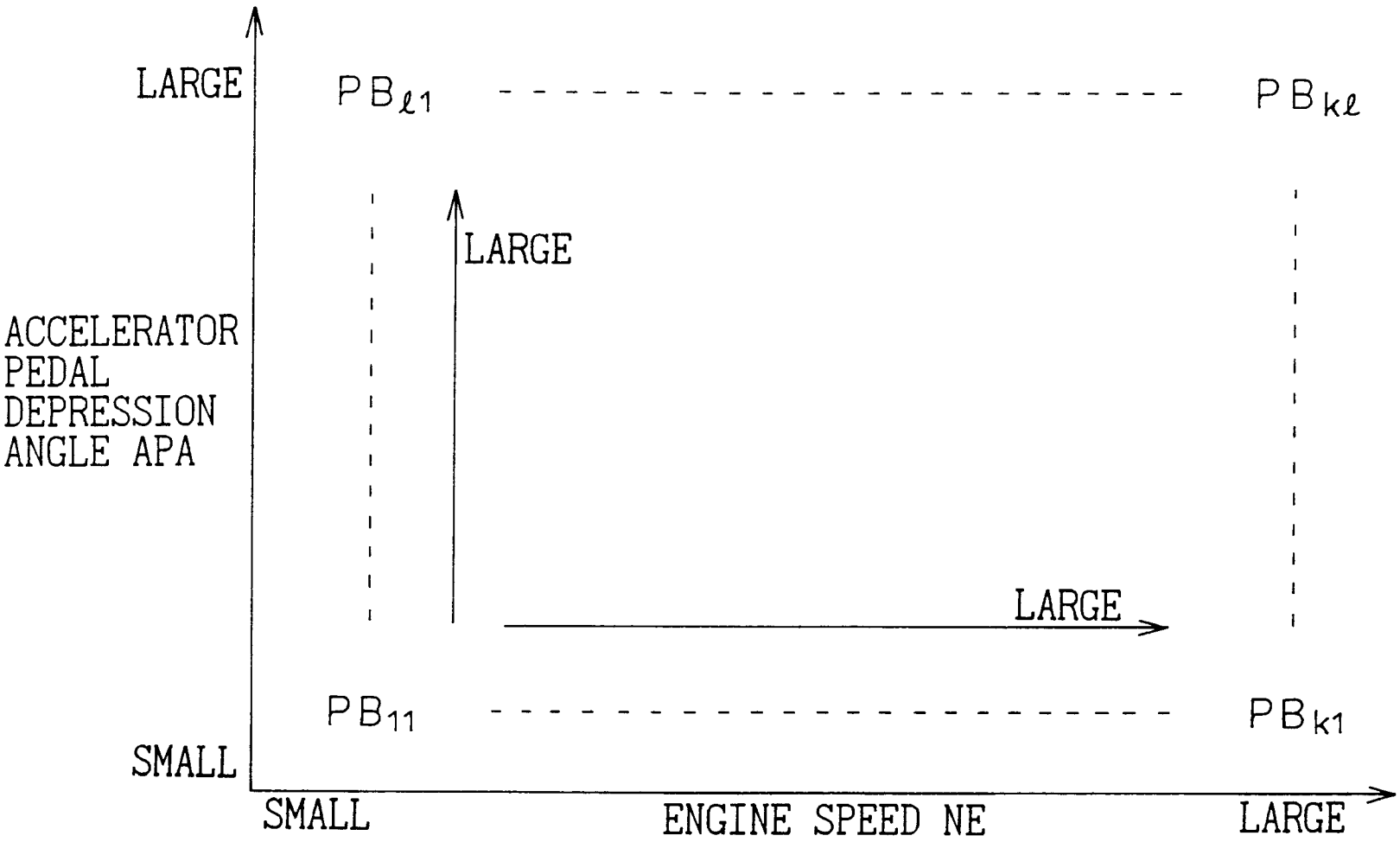
FIG. 7 is a diagram showing a required basic power supply to engine speed and acceleration pedal opening angle, which is used for the first variation of the first embodiment.

In the first variation of the first embodiment, based on engine speed NE detected by engine speed sensor 18 and the accelerator pedal depression angle APA detected by accelerater pedal depression angle sensor 19, a basic power supply PB is obtained from a map, as shown in FIG. 7, which is stored in ROM 34 of the ECU 30.

Figure 8:
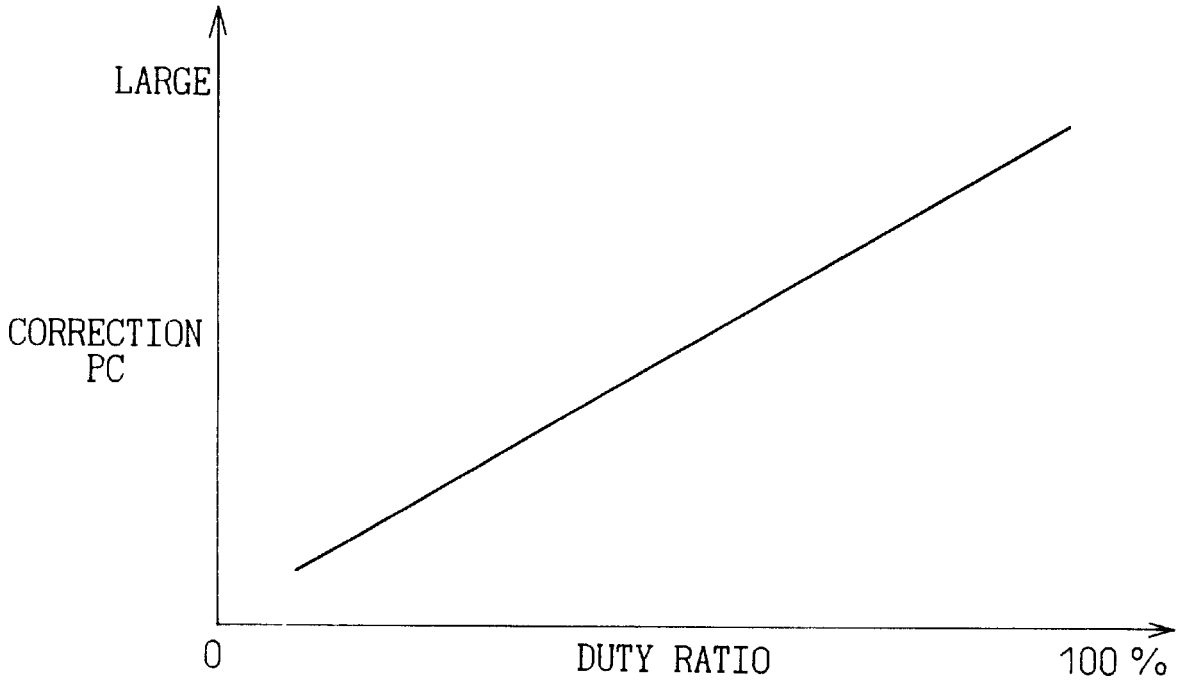
FIG. 8 is a diagram showing a correction to basic power supply in accordance with a duty ratio of a duty solenoid valve of the EGR control valve, which is used for the first variation of the first embodiment.

Corresponding to a duty signal which is sent from ECU 30 to duty solenoid valve 15 for operating the EGR valve 9, a power supply correction PC is obtained from a map as shown in FIG. 8. Then, the actual power supply PA is calculated by subtracting the power supply correction PC from the basic power supply PB, as in the first embodiment.

Figure 9:
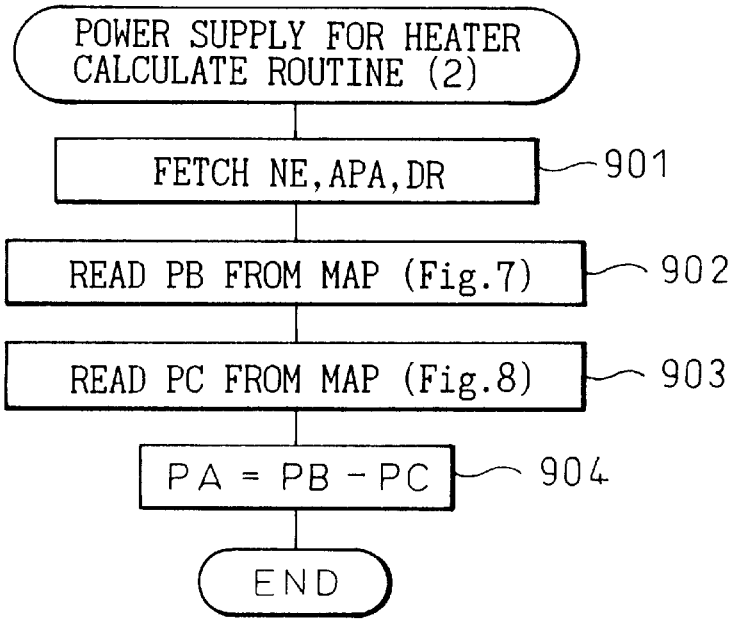
FIG. 9 is a flow chart for executing a control by the first variation of the first embodiment of the present invention.

Shown in FIG. 9 is a flow chart to execute the above described control routine. In step 901, engine speed NE, intake passage pressure PM, and intake air temperature TA are fetched. In step 902, a basic power supply PB corresponding the engine speed NE and the intake passage pressure PM is obtained from a map. In step 903, a correction PC corresponding to the intake air temperature TA is obtained from a map. Finally, in step 904, an actual power supply PA is calculated by subtracting the power supply correction PC from the basic power supply PB.

Figure 10:
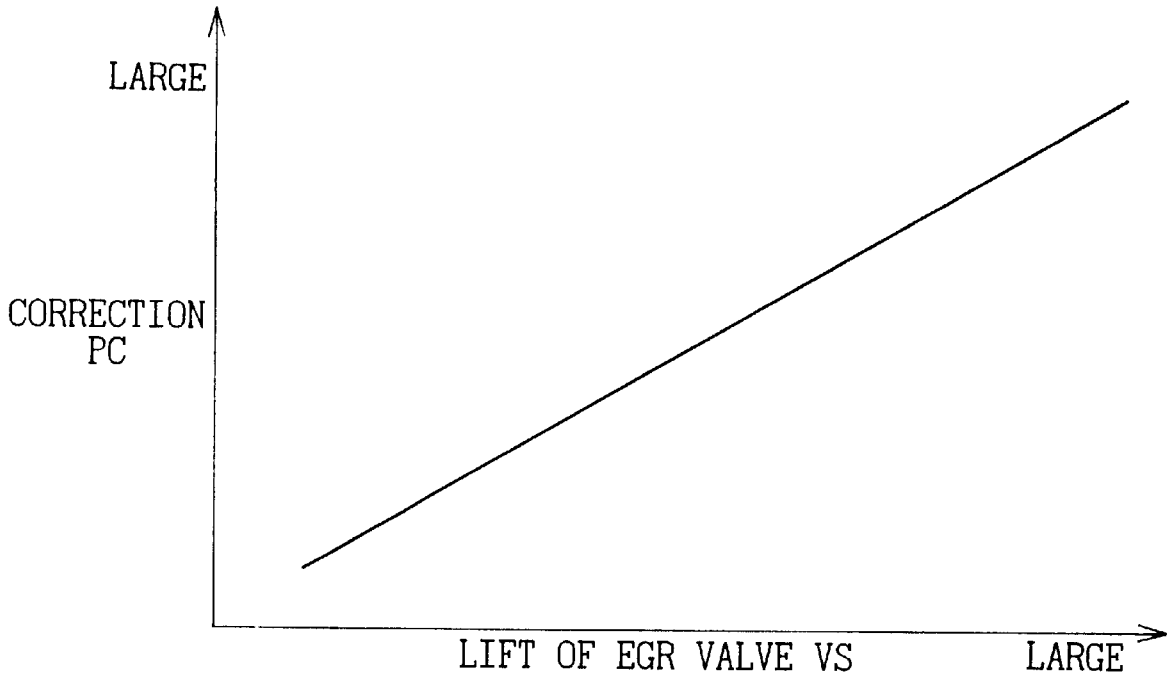
FIG. 10 is a diagram showing a correction to basic power supply in accordance with a lift value a valve element of EGR control valve, which is used for the second variation of the first embodiment.

In the second variation of the first embodiment, the power supply correction PC is obtained from a map as shown in FIG. 10, based on the valve lift VS which is detected by a valve lift sensor 20 which is located in the EGR valve 9, instead of using a duty signal which is sent to the duty solenoid valve 15.

Figure 11:
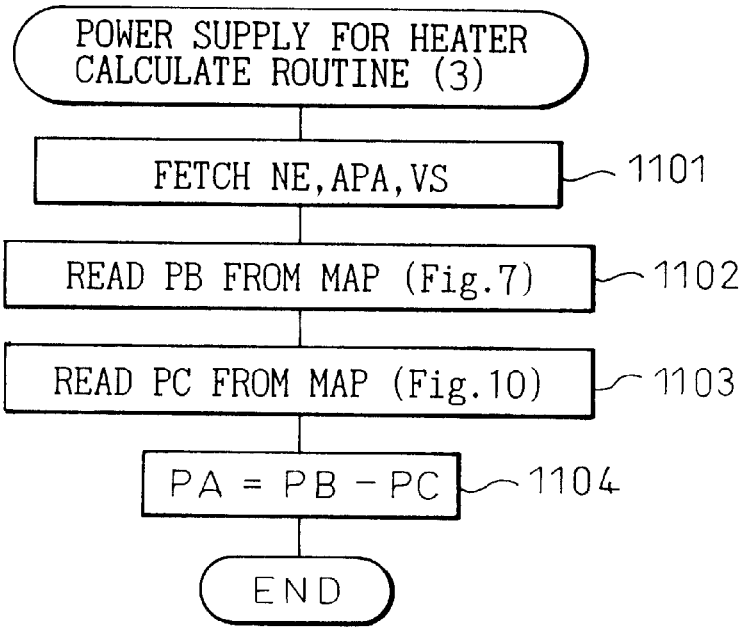
FIG. 11 is a flow chart for executing a control by the second variation of the first embodiment of the present invention.

Shown in FIG. 11 is a flow chart to execute above described control routine of the second variation of the first embodiment, which is basically same as the flow chart shown in FIG. 9 for the first variation of the first embodiment, except that step 1103 is changed as described above.

The amount of EGR gas varies not only corresponding to duty ratio DR or lift of EGR valve, but also corresponding to the amount of exhaust gas, i.e. the running condition. Therefore, higher control accuracy can be obtained by determining the power supply correction PC on the basis of a duty ratio DR, an engine speed NE, and/or an accelerator pedal opening angle APA.

In the third variation of the first embodiment, a basic power supply PB is obtained from a map, as shown in FIG. 4, which is stored in the ROM 34 of the ECU 30 based on an engine speed NE detected by engine speed sensor 18 and an intake passage pressure PM detected by intake passage pressure sensor 17.

The temperature of the air fuel ratio sensor 10, and the oxygen concentration of air in the intake passage, is effected by the amount of EGR gas. Therefore, power supply correction PC is calculated from an output of the air fuel ratio sensor 10 according to the following equation (2).

$$PC=a\times(OAM-OIN) \quad \ldots (2)$$

wherein,

OAM is an oxygen concentration in the atmosphere, i.e. the oxygen concentration in fresh air introduced into the intake passage 4. OAM can be set as a constant value of 0.21, or can be determined from a oxygen concentration detected by the air fuel ratio sensor when the EGR valve is closed.

OIN is the oxygen concentration in the air in the intake passage 4 detected by the air fuel ratio sensor 10.

"a" is a predetermined constant value.

Figure 12:
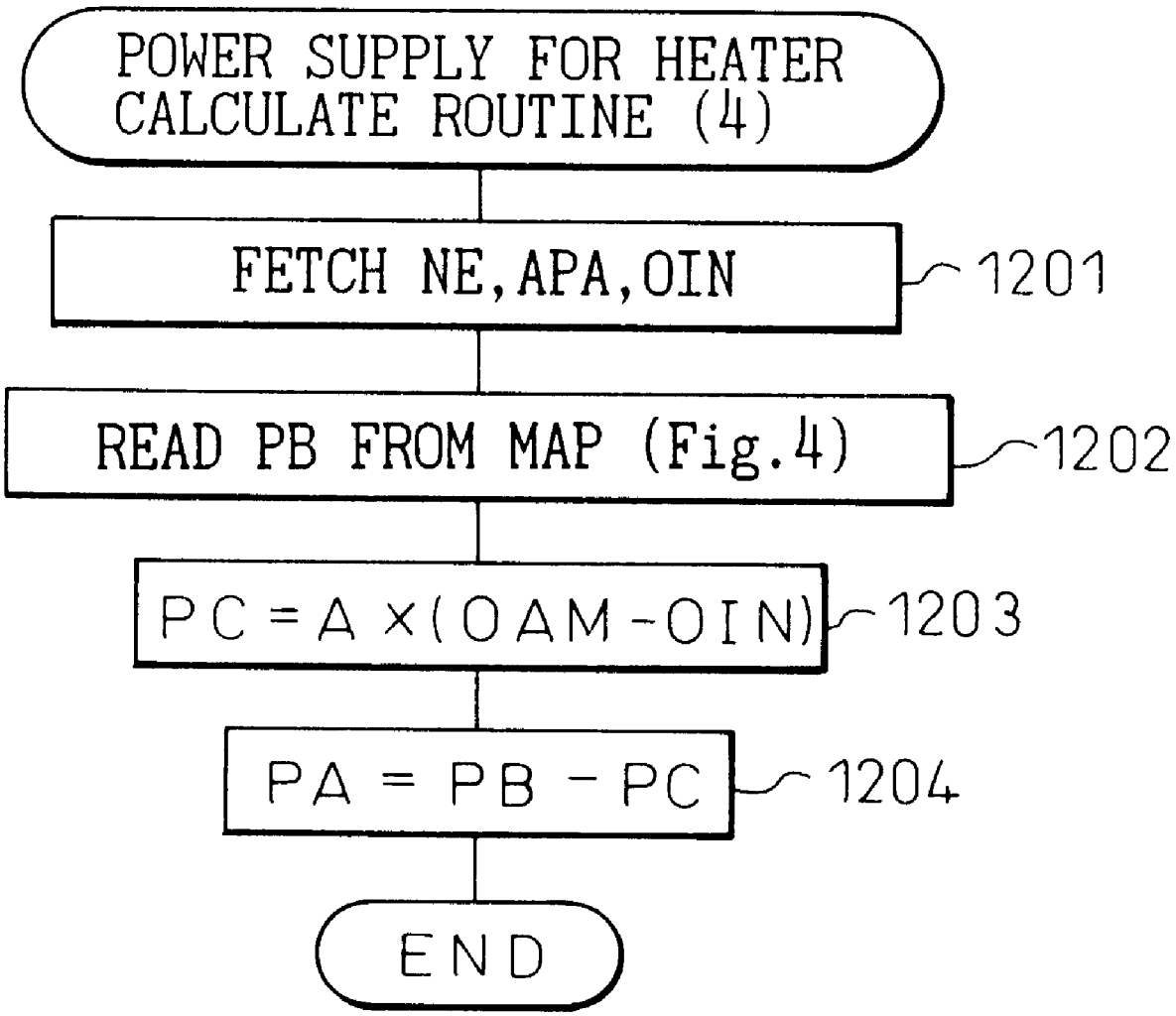
FIG. 12 is a flow chart for executing a control by the third variation of the first embodiment of the present invention.

Shown in FIG. 12 is a flow chart to execute the above described control routine. In step 1201, engine speed NE, intake passage pressure PM, and oxygen concentration OIN are fetched. In step 1202, a basic power supply PB corresponding to the engine speed NE and the intake passage pressure PM are obtained from a map. In step 1203, a correction PC is calculated according to the formula (2). Finally, in step 1204, an actual power supply PA is calculated by subtracting the power supply correction PC from the basic power supply PB.

In the above embodiment and three variations thereof are described. However, any combination of the method of obtaining a basic power supply and the method of obtaining a power supply correction can be used. Also, another method can be used. For example, in the case of an engine having an air flow meter, a basic power supply can be calculated from engine speed and an amount of intake air detected by the air flow meter.

Figure 13:
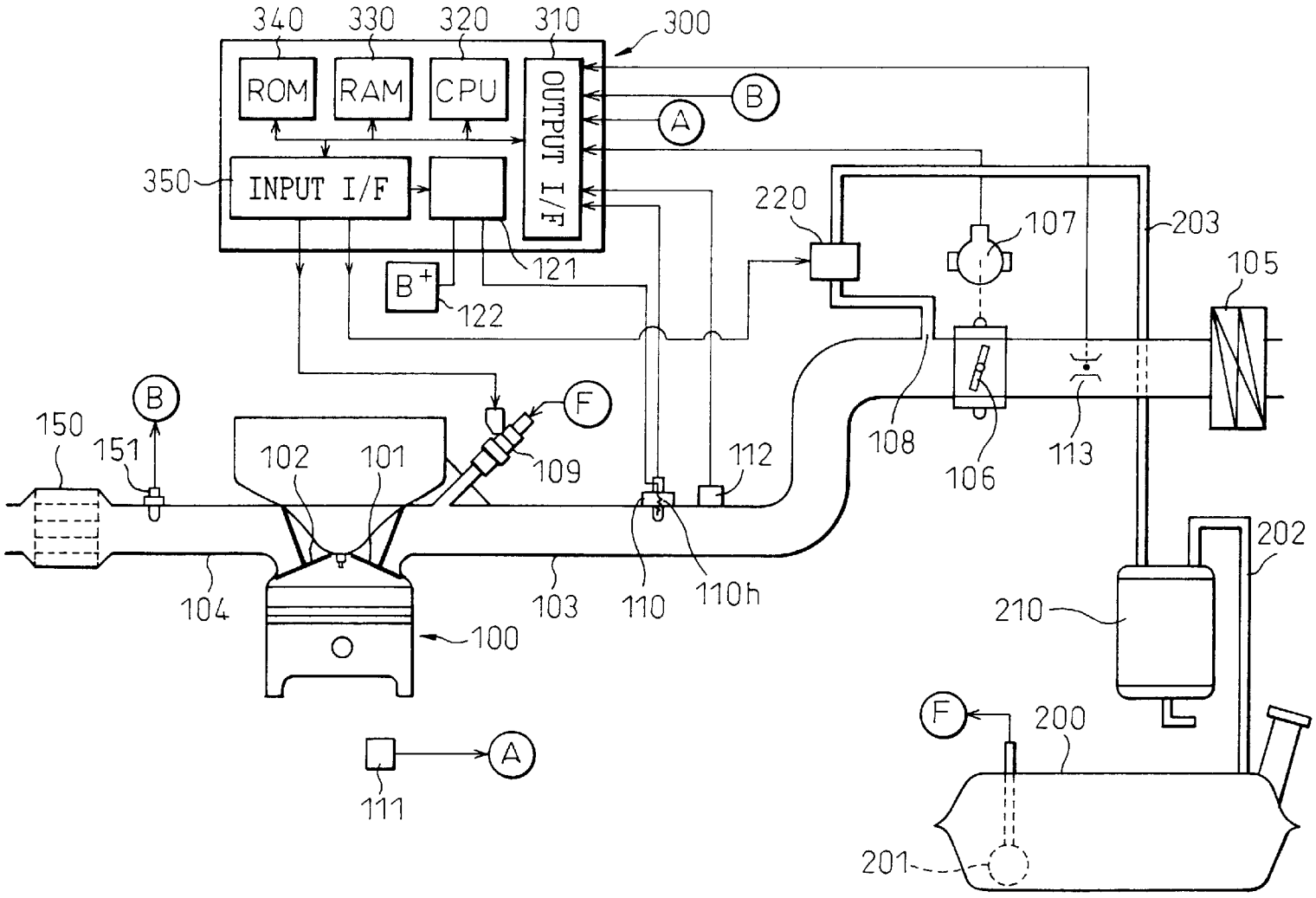
FIG. 13 shows a general construction of the second embodiment of the present invention.

Hereinafter, the second embodiment of the present invention regarding the gasoline engine is described. Referring to FIG. 13, a gasoline engine 100 has an intake passage 103 which introduces intake air into an intake valve 101, and an exhaust gas passage 104 which introduces exhaust gas discharged from exhaust valve 102 to the atmosphere. An air cleaner 105 is located at the most upstream portion of the intake passage 104. A throttle valve 106, located downstream of the air cleaner 105, changes the passage area of the intake passage 103 in accordance with a depression of the accelerator pedal (not shown). A throttle opening angle sensor 107 generates a signal proportional to the throttle angle of the throttle valve 106. An engine speed sensor 111 produces an output signal representing engine speed. These output signals are input to the input interface 310 of ECU (Electronic Control Unit) 300.

Fuel in a fuel tank 200 is sent to fuel injectors 108 and, thereby, fuel is injected into intake passage 103 at the portion near to the intake valve 101. Evaporated fuel gas produced in the fuel tank 200 is introduced into a canister 210 through the evaporation pipe 202, and adsorbed by an activated carbon layer (not shown) contained in the canister 210.

The evaporated fuel gas adsorbed by an activated carbon layer of the canister 210 is purged into the intake passage 103 through a purge pipe 203 and an purge port 108 formed in the downstream of the throttle valve 106. A purge control valve 220 is located midway in the purge pipe 203 to control the purging of the evaporated fuel gas.

An air fuel ratio sensor 110 for detecting the oxygen concentration of intake air is located in an intake passage 103 in the downstream of the purge port 108. The air fuel ratio sensor 110 has a same construction as the sensor 10 in the first embodiment. Power supplied from a power source 122 to a heater 110h of the air fuel ratio sensor 110 is controlled by a heater control circuit 121. An intake air temperature sensor 112 for detecting a temperature of an inlet air around the air fuel ratio sensor 110 is located near the air fuel ratio sensor 110.

A catalytic convertor 150 is located midway in the exhaust passage 104. An exhaust gas air fuel ratio sensor 151 is located upstream of the catalytic convertor 150. The amount of fuel injected from the fuel injector 109 is controlled by feedback method on the basis of a signal generated by the exhaust gas air fuel ratio sensor 151.

The ECU 300 is a digital computer having an input interface 310, CPU (Central Processing Unit) 320, RAM (Random Access Memory) 330, ROM (Read Only Memory) 340, and output interface 350 which are interconnected to each other.

The ECU 300 controls electric power supply to the heater 10h based on signals from sensors as described below so that air fuel ratio sensor 100 is kept at a predetermined temperature. The ECU 300 also executes other controls, for example, ignition timing.

The amount of fuel to be injected from the fuel injector 109 corresponding to the amount of intake air introduced through the air cleaner is calculated on the basis of the signal generated by the exhaust gas air fuel ratio sensor 151. The mixture gas of air and fuel determined as described above is introduced into the cylinder of the engine 100 through the intake valve 101, so that air fuel ratio of the exhaust gas is kept to a target air fuel ratio.

When evaporated fuel gas is purged from the canister 210, the air fuel ratio of inlet air in the intake passage 103 become rich. Therefore, it is required to control the amount of purge gas or to decrease the amount of fuel injected from the fuel injector 109 by the amount of the purged fuel, to eliminate excessive enrichment of the air fuel ratio.

In the present invention the change of air fuel ratio of intake air is detected by the air fuel ratio sensor 110 located in the intake passage 103, while in the prior art the change of air fuel ratio of intake air is detected by the exhaust gas air fuel ratio sensor 151. Therefore, in the present invention the change of air fuel ratio can be detected with good response and high accuracy compared to the prior art. However, to keep the air fuel ratio sensor 110 at the activating temperature thereof, it is necessary to detect the air fuel ratio with high accuracy. Therefore, heater 110h is required like as the first embodiment.

The principle of the control of the power supply for the heater of the second embodiment is same as the case of the first embodiment.

In the second embodiments of the present invention, basic power supply PB is calculated based on an inlet air amount related parameter detected by inlet air amount related parameter detecting means and the basic power supply PB is corrected by power supply correction PC which is calculated based on ambient temperature related parameter detected by ambient temperature related parameter detecting means, as in the first embodiment.

Figure 14:
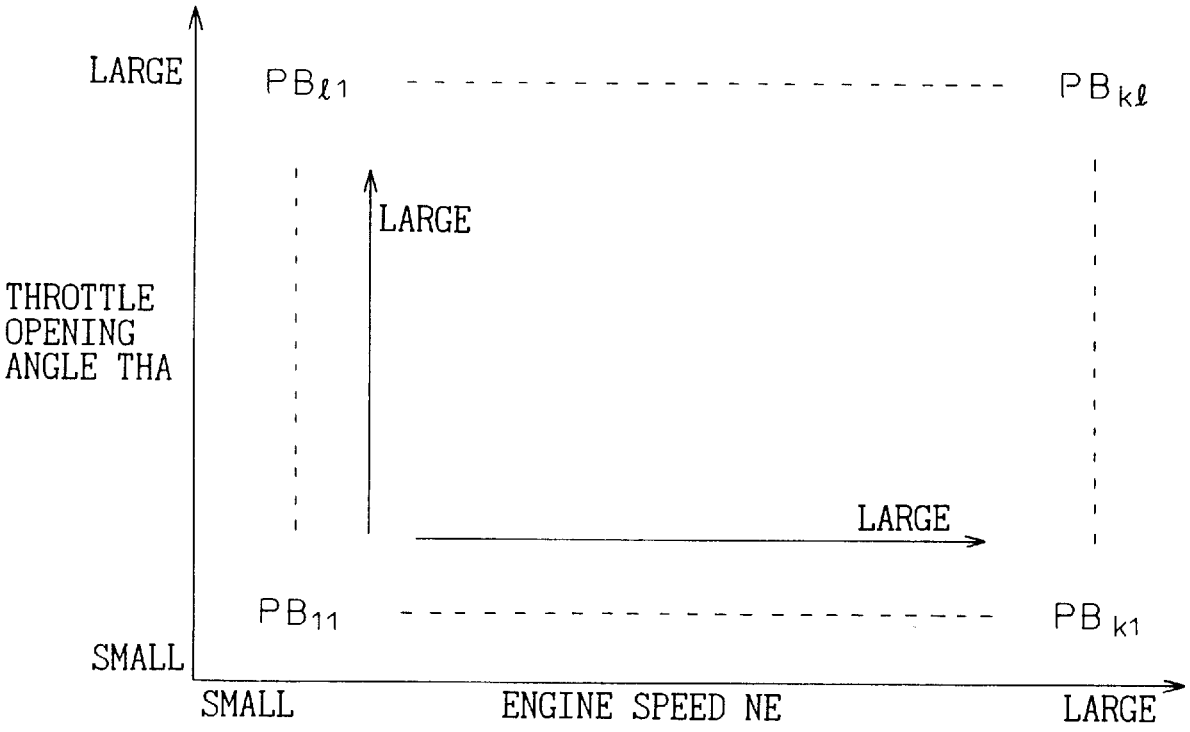
FIG. 14 is a diagram showing a required basic power supply to engine speed and throttle opening angle, which is used for the second embodiment of the present invention.

In the second embodiment, based on the engine speed NE detected by engine speed sensor 111 and the throttle opening angle THA detected by throttle sensor 107, the basic power supply PB is obtained from a map, as shown in FIG. 14, which is stored in ROM 340 of the ECU 300. The power supply correction PC is obtained from a map, which is same as the one shown in FIG. 5 and stored in ROM 340 of the ECU 300, based on a intake air temperature TA detected by intake air temperature sensor 112.

Figure 15:
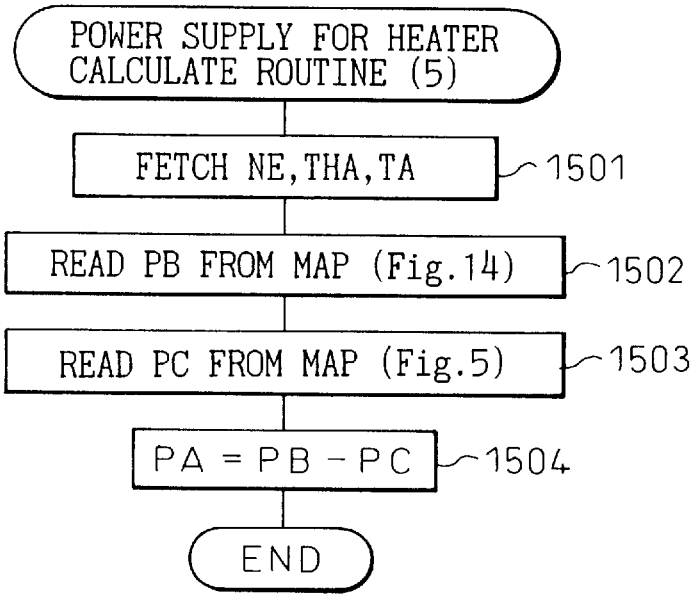
FIG. 15 is a flow chart for executing a control by the second embodiment of the present invention.

Shown in FIG. 15 is a flow chart to execute the above described control routine. In step 1501, engine speed NE, throttle opening angle THA, and intake air temperature TA is fetched. In step 1502, the basic power supply PB corresponding to the engine speed NE and throttle opening angle THA is obtained from a map. In step 1503, the correction PC corresponding to intake air temperature TA is obtained from a map. Finally, in step 1504, the actual power supply PA is calculated by subtracting power supply correction PC from basic power supply PB.

Figure 16:
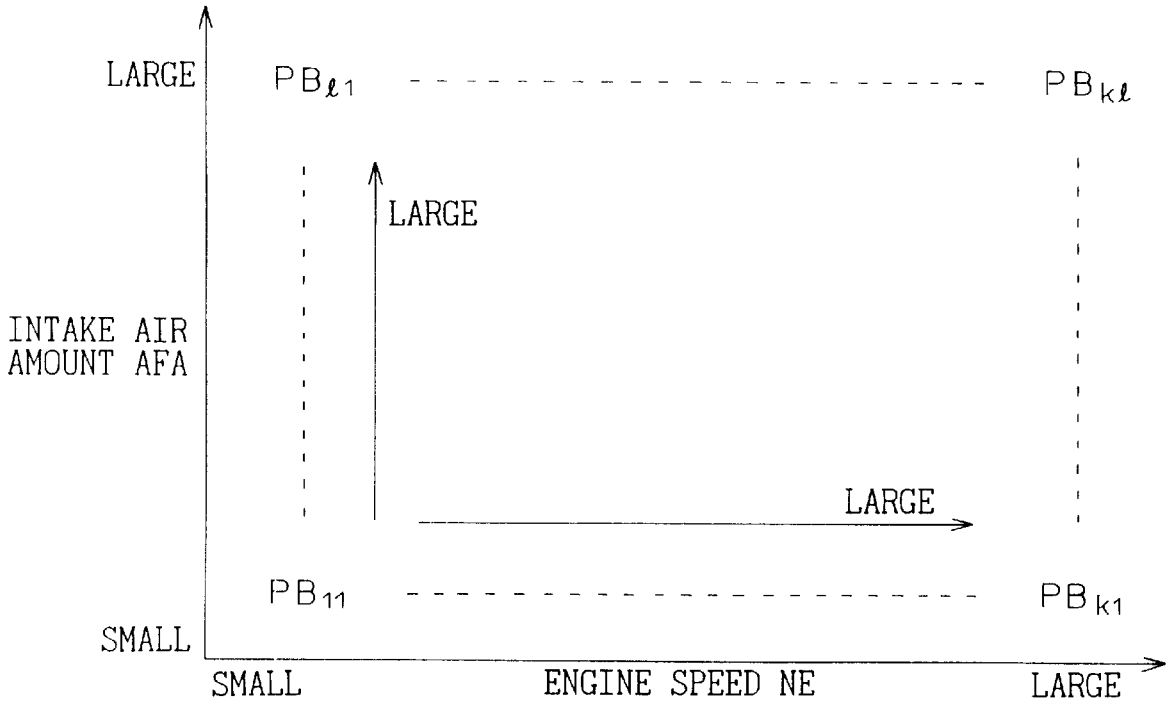
FIG. 16 is a diagram showing a required basic power supply to engine speed and intake air flow rate, which is used for a variation of the second embodiment.

In a variation of the second embodiment, based on engine speed NE detected by engine speed sensor 111 and intake air flow amount AFA detected by air flow meter 113, basic power supply PB is obtained from a map, as shown in FIG. 16, which is stored in ROM 340 of the ECU 300. The power supply correction PC is obtained from a map which is same as the one shown in FIG. 5 and stored in ROM 340 of the ECU 300, based on a intake air temperature TA detected by intake air temperature sensor 112.

Figure 17:
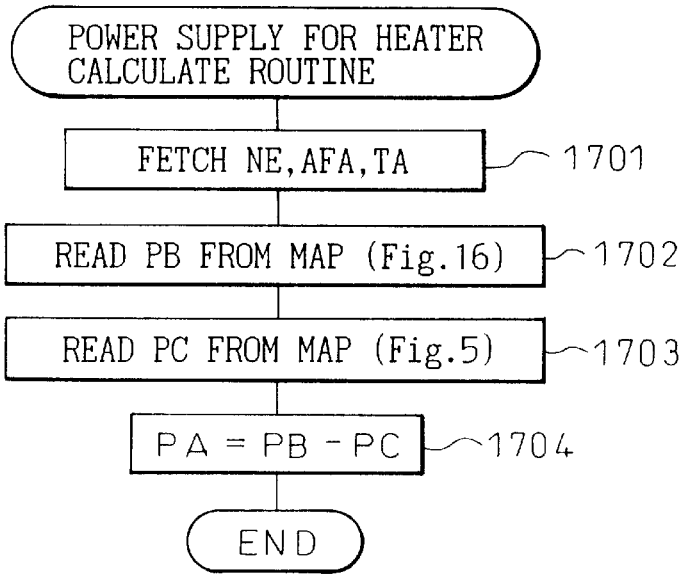
FIG. 17 is a flow chart for executing a control by a variation of the second embodiment of the present invention.

Shown in FIG. 17 is a flow chart to execute the above described control routine. In step 1701, engine speed NE, an intake air flow amount AFA, and intake air temperature TA is fetched. In step 1702, the basic power supply PB corresponding to the engine speed NE and the intake air flow amount AFA is obtained from a map. In step 1703, the correction PC corresponding to the intake air temperature TA is obtained from a map. Finally, in step 1704, the actual power supply PA is calculated by subtracting the power supply correction PC from the basic power supply PB.

In the above, a gasoline engine having an evaporated gas purging system is described as the second embodiment. However, any combination of the method of obtaining basic power supply and the method of power supply correction can be used, as described in the first embodiment and its variations.

As described above, according to the present invention, the power supply for the heater of the air fuel ratio sensor is determined not only based on the amount of fresh air introduced into intake passage but also upon the ambient temperature of the air fuel ratio sensor, and thereby the air fuel ratio sensor is stabilized so that it can output a correct signal.

I claim:

1. A control device for a heater for an air fuel ratio sensor attached close to a sensor element of said air fuel ratio sensor located in an intake passage of an internal combustion engine, comprising:

an ambient temperature related parameter detecting means for detecting a parameter related ambient temperature of said air fuel ratio sensor;

an intake air amount related parameter detecting means for detecting a parameter related amount of intake air introduced into the intake passage; and a supply power controlling means for controlling power supplied to said heater based on the ambient temperature related parameter detected by the ambient temperature related parameter detecting means and the intake air amount related parameter detected by the intake air amount related parameter detecting means.

2. A control device for a heater for an air fuel ratio sensor according to claim 1, wherein the ambient temperature related parameter detecting means is an intake air temperature sensor.

3. A control device for a heater for an air fuel ratio sensor according to claim 1, wherein an exhaust gas recirculating means is used to recirculate a part of exhaust gas from an exhaust gas passage into said intake passage upstream of said air fuel ratio sensor, said exhaust gas recirculating means comprises an exhaust gas recirculating pipe connecting an exhaust gas intake opening formed on said exhaust gas passage and an exhaust gas discharge opening formed in said intake passage, and an exhaust gas recirculation control valve located midway in the exhaust gas recirculating pipe.

4. A control device for a heater for an air fuel ratio sensor according to claim 1, wherein ambient temperature related parameter detecting means includes a recirculating exhaust gas amount detecting means for detecting a recirculating exhaust gas amount, and obtains an ambient temperature related parameter from said recirculating exhaust gas amount.

5. A control device for a heater for an air fuel ratio sensor according to claim 3, wherein said recirculating exhaust gas amount detecting means detects a recirculating exhaust gas amount from the driving amount of exhaust gas recirculation control valve.

6. A control device for a heater for an air fuel ratio sensor according to claim 3, wherein said recirculating exhaust gas amount detecting means detects a recirculating exhaust gas amount from the output of said air fuel ratio sensor.

7. A control device for a heater for an air fuel ratio sensor according to claim 1, wherein evaporated fuel gas is introduced into said intake passage upstream of said air fuel ratio sensor through an evaporated fuel gas control device.

8. A control device for a heater for an air fuel ratio sensor according to claim 1, wherein a basic power supply is calculated from an intake air amount related parameter detected by said intake air amount related parameter detecting means, a power supply correction for correcting said basic power supply is calculated from an ambient temperature related parameter detected by ambient temperature related parameter detecting means, and an actual power supply is calculated by correcting said basic power supply by said power supply correction.

9. A control device for a heater for an air fuel ratio sensor according to claim 1, wherein said intake air amount related parameter detecting means detects an intake air amount related parameter from an engine speed detected by an engine speed sensor and an intake passage pressure.

10. A control device for a heater for an air fuel ratio sensor according to claim 1, wherein said intake air amount related parameter detecting means detects an intake air amount related parameter from an engine speed detected by an engine speed sensor and an accelerator pedal depression angle.

11. A control device for a heater for an air fuel ratio sensor according to claim 1, wherein said intake air amount related parameter detecting means detects an intake air amount related parameter from an engine speed detected by an enaine speed sensor and a throttle opening angle.

12. A control device for a heater for an air fuel ratio sensor according to claim 1, wherein said intake air amount related parameter detecting means detects an intake air amount related parameter from an engine speed detected by an engine speed sensor and an amount of intake air.

* * * * *